US011553767B2

(12) United States Patent
Cazalet et al.

(10) Patent No.: US 11,553,767 B2
(45) Date of Patent: Jan. 17, 2023

(54) BAYONET MECHANISM FOR INTERCHANGEABLE LUG AND BAND STYLES

(71) Applicant: Google LLC, Mountain View, CA (US)

(72) Inventors: Peter Michael Cazalet, Los Gatos, CA (US); Gina Reimann, Los Gatos, CA (US); Jade Daniel Moreau, Mountain View, CA (US)

(73) Assignee: Google LLC, Mountain View, CA (US)

( * ) Notice: Subject to any disclaimer, the term of this patent is extended or adjusted under 35 U.S.C. 154(b) by 440 days.

(21) Appl. No.: 16/731,176

(22) Filed: Dec. 31, 2019

(65) Prior Publication Data

US 2021/0177107 A1 Jun. 17, 2021

Related U.S. Application Data

(60) Provisional application No. 62/948,389, filed on Dec. 16, 2019.

(51) Int. Cl.
*A44C 5/14* (2006.01)

(52) U.S. Cl.
CPC ..... *A44C 5/14* (2013.01)

(58) Field of Classification Search
CPC ..... A44C 5/14; A44C 5/2014; A44C 5/2057; A44C 5/2061; G04B 37/005; A44B 99/005; A44B 17/00; G06F 1/1654; F16B 21/12
USPC ..... 368/282
See application file for complete search history.

(56) References Cited

U.S. PATENT DOCUMENTS

| | | | | |
|---|---|---|---|---|
| 4,982,581 | A | 1/1991 | Furuyama | |
| 10,317,845 | B2 * | 6/2019 | Zhang | G04G 21/02 |
| 2002/0085455 | A1 | 7/2002 | Haida | |
| 2006/0189218 | A1 * | 8/2006 | Uhari | G04B 37/1413 439/752 |
| 2015/0131216 | A1 * | 5/2015 | Huang | G06F 3/014 361/679.03 |
| 2015/0296963 | A1 * | 10/2015 | Byun | G04G 17/08 224/191 |
| 2016/0069371 | A1 * | 3/2016 | Chen | A44B 11/263 29/446 |

(Continued)

FOREIGN PATENT DOCUMENTS

| | | | | |
|---|---|---|---|---|
| CH | 709475 A2 * | 10/2015 | | G04B 37/005 |
| CH | 709475 A2 | 10/2015 | | |

(Continued)

*Primary Examiner* — Edwin A. Leon
*Assistant Examiner* — Kevin Andrew Johnston
(74) *Attorney, Agent, or Firm* — Lerner, David, Littenberg, Krumholz & Mentlik, LLP

(57) ABSTRACT

A watch system is provided, including a watchband, a lug bucket, and a puck. The watchband may include a flexible member configured to be mounted onto a wrist of a user. The lug bucket may be coupled to the electronic watch band and may include a circular ledge. The puck may include watch functionality. The puck may be configured to be removably coupled to the lug bucket. The lug bucket and the puck may have corresponding locking features that are configured to rotationally and translationally fix the puck to the lug bucket. The corresponding locking features may be configured to be engaged when the puck is translated relative to the lug bucket and rotated relative to the lug bucket by a predetermined rotation angle.

20 Claims, 7 Drawing Sheets

(56) References Cited

U.S. PATENT DOCUMENTS

2020/0387113 A1* 12/2020 Neighbors ..... G04B 19/283

FOREIGN PATENT DOCUMENTS

| | | | |
|---|---|---|---|
| CN | 107632512 | A | 1/2018 |
| DE | 29923612 | U1 | 4/2001 |
| DE | 202005013615 | U1 | 11/2005 |
| EP | 0662648 | A1 | 7/1995 |
| EP | 1694106 | A1 | 8/2006 |
| EP | 3599519 | A1 | 1/2020 |
| GB | 2249709 | A | 5/1992 |
| WO | 2021099567 | A1 | 5/2021 |

* cited by examiner

BAYONET MECHANISM FOR INTERCHANGEABLE LUG AND BAND STYLES

CROSS-REFERENCE TO RELATED APPLICATIONS

The present application claims the benefit of the filing date of U.S. Provisional Patent Application No. 62/948,389 filed Dec. 16, 2019, the disclosure of which is hereby incorporated herein by reference.

BACKGROUND

Conventional watches and smartwatches permit changing the watchband at the lugs (i.e., projections on the watch casing that couple to the watchband) to customize the material and the color of the watchband. However, such conventional watches and smartwatches typically limit the number of lug styles that are possible, and changing the material or the color of the watch casing is usually not permitted. For such conventional watches and smartwatches, many different stock keeping units ("SKUs") would be needed in order to permit the user to select the material or the color of the watch casing, which may be costly and may require complicated inventory control.

BRIEF SUMMARY

The present disclosure provides for a modular design of a watch or smartwatch that permits customization of the material and color of the watchband and body or casing. The watch or smartwatch is split into two components, including a "puck" that incorporates all of the functionality (display, battery, sensors, etc.) and a "lug bucket" that serves as the outer casing that incorporates the lugs and watchband attachments. The two components are coupled to one another by a bayonet mechanism that permits the lug bucket and watchband to be swapped with a simple rotation (e.g., about 30 degrees). The rotation of the puck can be locked either with a release button or held with a detent. The coupling mechanism includes tabs at the bottom of the puck that engage with corresponding slots on the lug bucket. The coupling mechanism is a secure connection that hides the bayonet mechanism when assembled.

One aspect of the disclosure provides a watch system including a watchband, a lug bucket, and a puck. The watchband may include a flexible member configured to be mounted onto a wrist of a user. The lug bucket may be coupled to the electronic watch band and may include a circular ledge. The puck may include watch functionality. The puck may be configured to be removably coupled to the lug bucket. The lug bucket and the puck may have corresponding locking features that are configured to rotationally and translationally fix the puck to the lug bucket. The corresponding locking features may be configured to be engaged when the puck is translated relative to the lug bucket and rotated relative to the lug bucket by a predetermined rotation angle.

The corresponding locking features may include a button that is configured to be inserted into a corresponding track and a tab that is configured to be inserted into a corresponding slot. The button and the tab each may extend from the puck, and the track and slot each may extend into the circular ledge of the lug bucket. The watch system may have an engaged configuration in which the button is rotationally locked relative to the lug bucket by interference between a side of the button and a feature of the circular ledge, and in which the tab is translationally locked relative to the lug bucket by interference between a surface of the tab and a corresponding confronting surface of the slot. In the engaged configuration, an outer lateral side of the button may interfere with an inner lateral surface of an opening extending within the corresponding track. The predetermined rotation angle may be between about 15° and about 120°. The puck may have smartwatch features including a display, sensors, and a battery.

Another aspect of the disclosure provides a coupling system including a lug bucket and a puck. The lug bucket may include a circular ledge. The puck may include watch functionality. The puck may be configured to be removably coupled to the lug bucket. The lug bucket and the puck may have corresponding locking features that are configured to rotationally and translationally fix the puck to the lug bucket. The corresponding locking features may be configured to be engaged when the puck is translated relative to the lug bucket and rotated relative to the lug bucket by a predetermined rotation angle.

The corresponding locking features may include a button that is configured to be inserted into a corresponding track and a tab that is configured to be inserted into a corresponding slot. The button and the tab each may extend from the puck, and the track and slot each may extend into the circular ledge of the lug bucket. The coupling system may have an engaged configuration in which the button is rotationally locked relative to the lug bucket by interference between a side of the button and a feature of the circular ledge, and in which the tab is translationally locked relative to the lug bucket by interference between a surface of the tab and a corresponding confronting surface of the slot. In the engaged configuration, an outer lateral side of the button may interfere with an inner lateral surface of an opening extending within the corresponding track. The predetermined rotation angle may be between about 15° and about 120°. The puck may have smartwatch features including a display, sensors, and a battery.

Yet another aspect of the disclosure provides a method of removably coupling a puck to a watchband assembly. The method may include providing the watchband assembly including a lug bucket coupled to a watchband comprising a flexible member configured to be mounted onto a wrist of a user, the lug bucket including a circular ledge. The method may also include translating the puck relative to the lug bucket and rotating the puck relative to the lug bucket by a predetermined rotation angle. The method may also include engaging corresponding locking features of the puck and the lug bucket during the translating and the rotating of the puck, the corresponding locking features rotationally and translationally fixing the puck to the lug bucket.

The translating of the puck may include inserting a button into a corresponding track and inserting a tab into a corresponding slot. The button and the tab each may extend from the puck, and the track and slot each may extend into the circular ledge of the lug bucket. The rotating of the puck may include moving the button within the corresponding track and moving the tab within the corresponding slot until the button is rotationally locked relative to the lug bucket by interference between a side of the button and a feature of the circular ledge, and until the tab is translationally locked relative to the lug bucket by interference between a surface of the tab and a corresponding confronting surface of the slot. The method may also include disengaging the puck from the lug bucket by rotating the puck relative to the lug bucket by the predetermined rotation angle and translating the puck relative to the lug bucket. The disengaging of the puck from the lug bucket may include depressing the button until the puck is no longer rotationally fixed to the lug bucket.

DETAILED DESCRIPTION

Figure 1A:
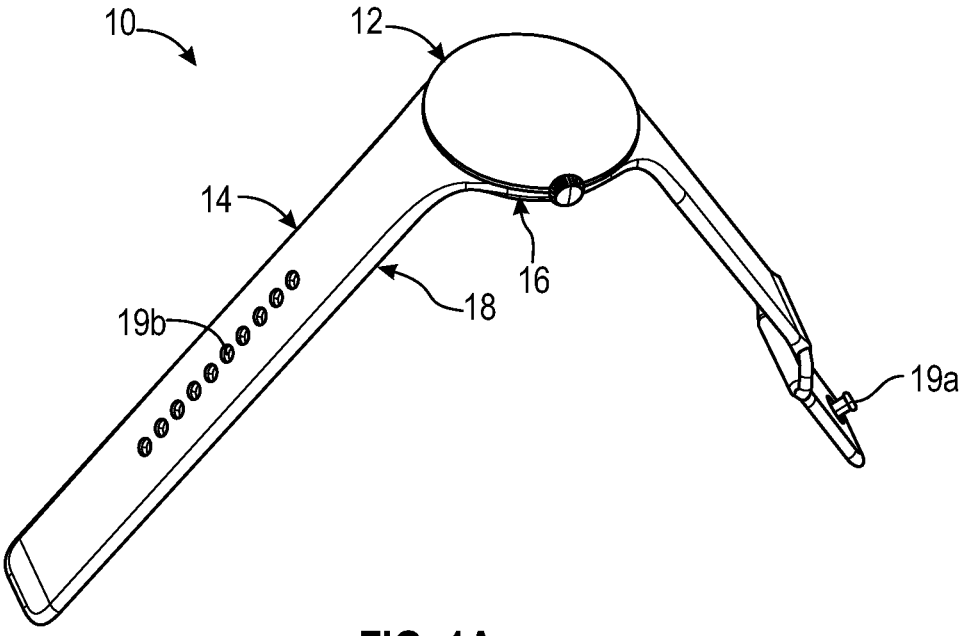
FIG. 1A illustrates a perspective view of a watch system according to an aspect of the disclosure.
Figure 1B:
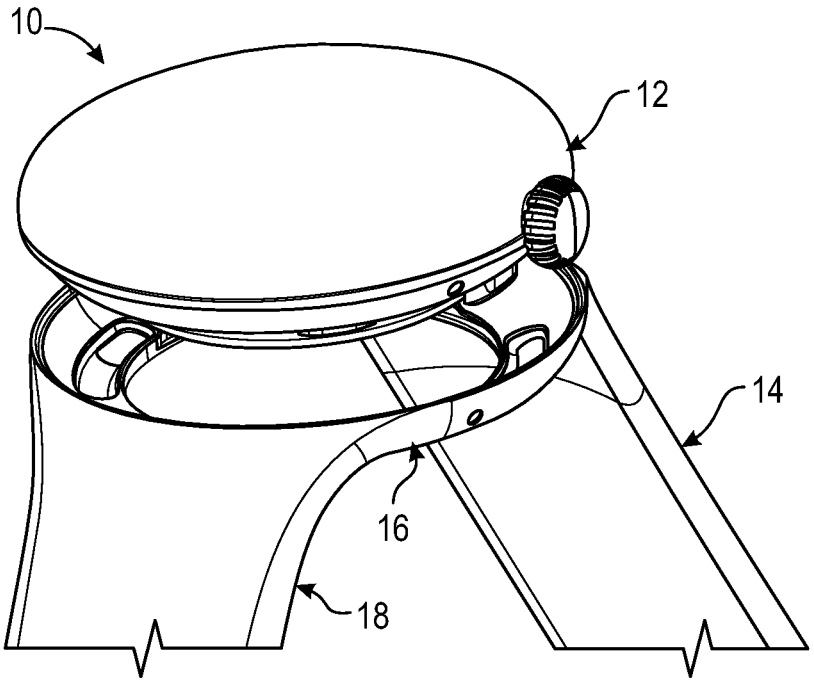
FIG. 1B is an enlarged perspective view of the puck, lug bucket, and watchband of FIG. 1A, with the puck shown spaced apart from the lug bucket and watchband.

Referring to FIGS. 1A and 1B, an example watch system 10 includes a puck 12 engaged with a lug bucket and watchband assembly 14. The example watch system 10 is shown as a smartwatch system, and the puck 12 is shown as an electronic watch that incorporates all of the smartwatch functionality (display, battery, sensors, etc.). However, in other examples, the watch system 10 may not be a smartwatch system, and the puck 12 may be a conventional watch that does not have any smartwatch functionality. The watchband assembly 14 includes a lug bucket 16 that serves as an outer casing for the puck 12 and that is coupled to a wristband 18. Although the lug bucket 16 and the wristband 18 are shown as being two adjacent parts of a single unitary component, in other examples, the lug bucket and the wristband may be separate components coupled to one another via lugs and watchband attachments.

The puck 12 is configured to be removably coupled to the lug bucket 16 via a bayonet mechanism that permits the watchband assembly 14 to be swapped with a simple rotation (e.g., about 30 degrees), as will be described below. The rotation of the puck 12 can be locked either with a release button or held with a detent, as will be described below. The coupling mechanism includes tabs at the bottom of the puck 12 that engage with corresponding slots on the lug bucket 16. The coupling mechanism is a secure connection that hides the bayonet features when assembled.

The lug bucket 16 and the wristband 18 are together configured to fit around a wrist of a user. The wristband 18 may be made of a flexible material, such as an elastomer. The wristband 18 may include closure elements such as a post 19*a* and a series of openings 19*b*, the post being configured to be removably coupled to any corresponding one of the openings.

Figure 2A:
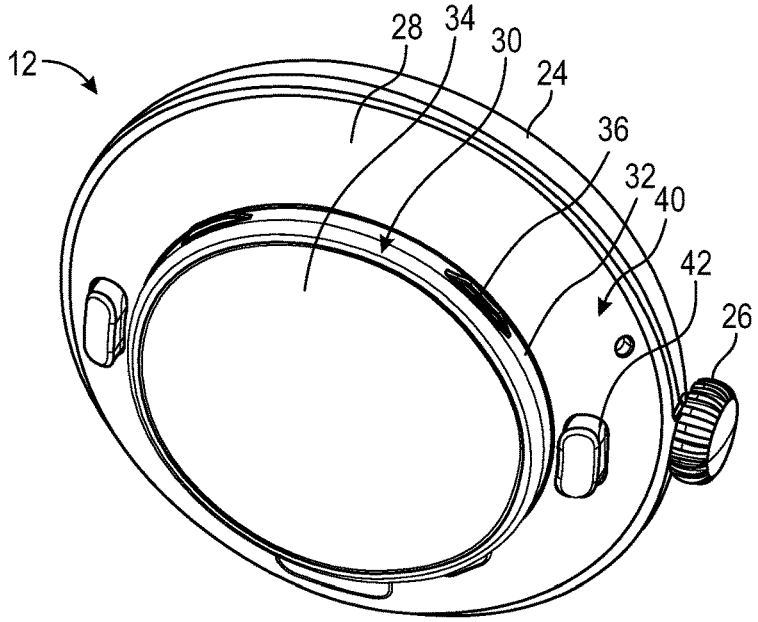
FIG. 2A is a perspective view of the connector of the puck of FIG. 1A.
Figure 2B:
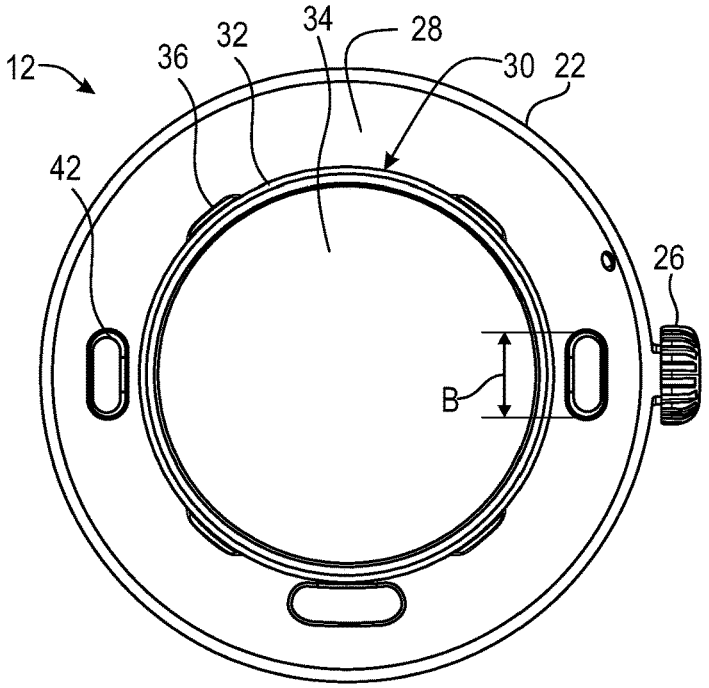
FIG. 2B is a bottom view of the puck of FIG. 1A.

As shown in FIGS. 2A-2D, the puck 12 includes an enclosure 20. An outer periphery 22 of the enclosure 20 is shown as having a circular shape, but in other examples, the outer periphery may have other shapes, including an oval, square, or rectangle. The puck 12 may include one or more microelectronic devices inside of the enclosure 20, such as a microprocessor and memory. The puck 12 may include a display 24 that is configured to show output from the one or more microelectronic devices. The puck 12 may include a control wheel 26 that is configured to permit a user to control smartwatch functionality. The puck 12 may also contain a battery, sensors, and other functional smartwatch components therein (not shown). As shown in FIG. 2B, a bottom surface 28 of the enclosure 20 may have a circular contour that is configured to mate with the contour of a corresponding surface of the lug bucket 16, which will be described below.

Figure 2C:
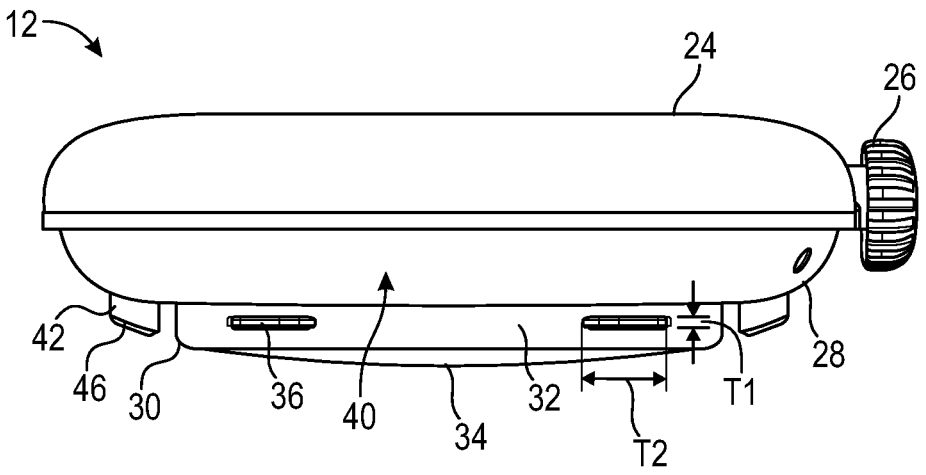
FIG. 2C is a side view of the puck of FIG. 1A.
Figure 2D:
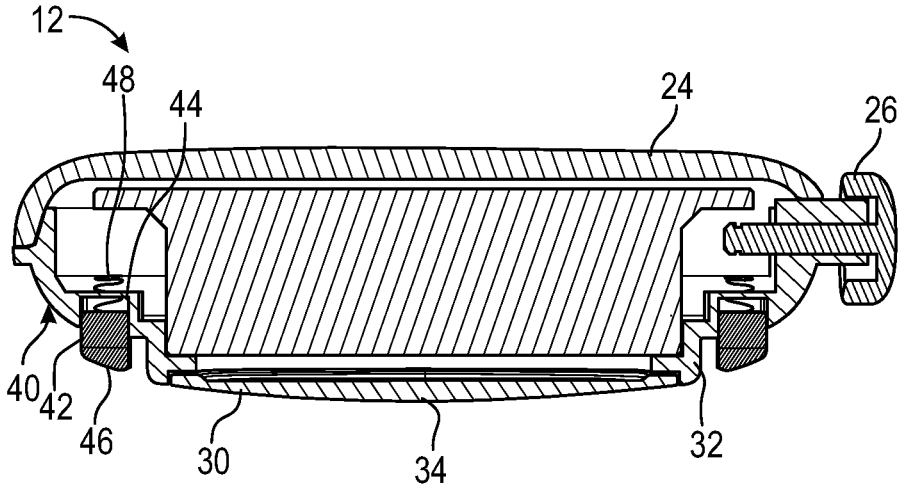
FIG. 2D is a side cross-sectional view of the puck of FIG. 2C.

The enclosure 20 may define a coupling protrusion 30 in the form of a cylinder that defines a central part of the bottom surface 28. The coupling protrusion 30 may have a cylindrical wall 32 that extends around an outer periphery of the coupling protrusion and that extends substantially perpendicularly from a peripheral portion of the bottom surface 28. The coupling protrusion 30 may also have a central surface 34 that extends across a lower edge of the cylindrical wall 32. The coupling protrusion 30 may have a plurality of tabs 36 circumferentially spaced about the cylindrical wall 32 and extending radially outward from the cylindrical wall. As shown in FIG. 2C, each tab 36 may have a height T1 in a direction substantially parallel to the cylindrical wall 32. As shown in FIG. 2B, there are four evenly-spaced tabs 36 that are equally distributed about the cylindrical wall 32 every 90°. However, in other examples, there may be any number of tabs, and the tabs may have any regular or irregular spacing about the cylindrical wall 32, so long as the tab spacing corresponds to complementary features of the lug bucket 16, as will be described below.

The enclosure 20 may define a peripheral ring 40 in the shape of a portion of a toroid. The peripheral ring 40 may have any outer shape, such as a circle, an oval, a square, a rectangle, an octagon, or the like. As long as the coupling protrusion 30 has a shape (e.g., a cylinder) that can be rotated relative to the lug bucket 16 so that the puck 12 can be coupled to the lug bucket, the peripheral ring 40, the display 24, and the outer periphery 22 of the enclosure 20 may have any of a variety of shapes, such as those mentioned above (e.g., a circle, an oval, a square, a rectangle, an octagon, or the like).

The peripheral ring 40 may extend between the cylindrical wall 32 and the outer periphery 22 of the enclosure 20. The peripheral ring 40 may have a plurality of buttons 42 extending substantially perpendicularly to the peripheral ring. The buttons 42 may extend from the peripheral ring 40 on opposite sides of the coupling protrusion 30. Each button 42 may be slidably mounted within a corresponding recess 44 (FIG. 2D) extending into the peripheral ring 40. Each button 42 may be biased to return to its initial position when it is pushed into the corresponding recess 44 by an external force, as will be described below. Each button 42 may have a lower end 46 that may protrude below the central surface 34 of the coupling protrusion 30 when in its initial position. As shown in FIG. 2B, each button 42 may have a length B in a circumferential direction substantially parallel to the cylindrical wall 32.

To provide the position bias for the buttons 42, each button may be coupled to the enclosure 20 via a spring element 48. The spring element 48 is shown in the figures as a coil spring, but any other energy storage element may be used (e.g., a leaf spring, a piece of a memory metal, or a piece of any other material (e.g., a flexible polymer) that can store energy when compressed. Each spring element 48 may extend from an upper surface of a corresponding button to a downward-facing surface located within the enclosure 20. In some examples, the buttons 42 may themselves be made of memory metal or another energy storage element (e.g., a flexible polymer) that may be compressed by an external force and restore to its initial position when the external force is removed.

As shown in FIGS. 2A-2D, there are two evenly-spaced buttons 42 that are equally distributed about the peripheral ring 40 every 180°. However, in other examples, there may be any number of buttons, and the buttons may have any regular or irregular spacing about the peripheral ring 40, so long as the button spacing corresponds to complementary features of the lug bucket 16, as will be described below. The buttons 42 are shown as having an oblong cross-section, but in other examples, the buttons may have any other cross-section, so long as the button shape corresponds to complementary features of the lug bucket 16, as will be described below.

As shown in FIGS. 3A-3D, the lug bucket 16 includes a circular ledge 50. The circular ledge 50 may have a top surface 51 and a bottom surface 52 opposite the top surface. The top surface 51 may have a concave shape that corresponds to a contour of the peripheral ring 40 of the puck 12. An outer periphery 53 of the circular ledge 50 is shown as having a circular shape, but in other examples, the outer periphery may have other shapes, including an oval, square, or rectangle. The circular ledge 50 may have a cylindrical wall 54 that defines the inner periphery of the top surface 51 and the bottom surface 52. The cylindrical wall 54 may extend substantially perpendicularly to the innermost portions of the top surface 51 and the bottom surface 52. The cylindrical wall 54 may define a central opening 56 that is configured to receive the coupling protrusion 30 of the puck 12 therethrough.

The circular ledge 50 may have a plurality of tracks 60 recessed into the top surface 51. Each track 60 may be configured to receive a corresponding one of the buttons 42 therein. As shown in the figures, each track 60 may extend circumferentially about a portion of the central opening 56, such that each track is configured to permit one of the buttons 42 to have a range of motion corresponding to a 30° rotation of the puck 12 relative to the lug bucket 16. It is preferable that the number of tracks 60 in the lug bucket 16 correspond to the number of buttons 42 in the puck 12.

Figure 3A:
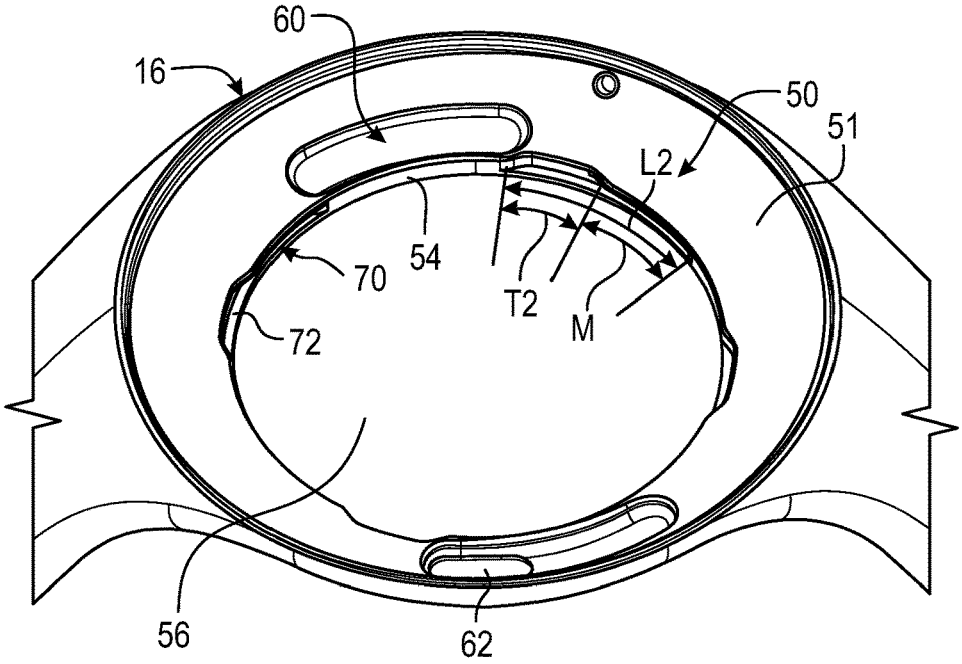
FIG. 3A is a top perspective view of the lug bucket of FIG. 1A.
Figure 3B:
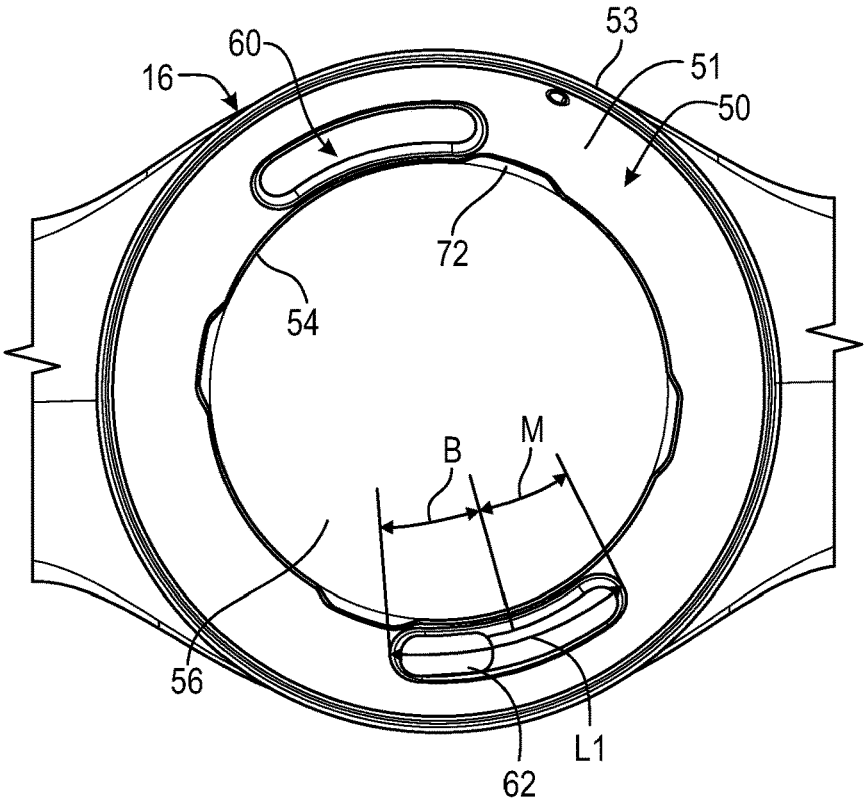
FIG. 3B is a top view of the lug bucket of FIG. 1A.

For example, referring to FIG. 3B, if the top surface 51 of the circular ledge 50 has a circumference of about 144 mm at the location of the tracks 60 between the outer periphery 53 and the cylindrical wall 54, and each button 42 has a length B of about 8 mm, to permit the puck 12 to have a range of rotational motion M of about 30° (a circumferential distance of about 12 mm, i.e., 1/12 of the circumference) when coupled to the lug bucket 16, each track would need to have a total length L1 of about 20 mm, which is the sum of the button length B and the range of rotational motion M.

As shown in the figures, one of the tracks 60 has an opening 62 at one end thereof that is configured to receive a corresponding one of the buttons 42 therethrough. The engagement of the button 42 into the opening 62 can rotationally lock the puck 12 to the lug bucket 16 by interference between outer lateral sides of the button and an inner lateral surface of the opening 62. The rotational lock may be released by a user depressing the respective button 42 to withdraw it from the corresponding opening 62, as will be described more fully below.

The circular ledge 50 may have a plurality of slots 70 recessed into the cylindrical wall 54. Each slot 70 may extend radially outward into the cylindrical wall 54 and may extend in a circumferential direction. The slots 70 may be circumferentially spaced about the cylindrical wall 54. Each slot 70 may be configured to receive a corresponding one of the tabs 36 of the puck 12 therein. As shown in the figures, each slot 70 may extend circumferentially about a portion of the central opening 56, such that each slot is configured to permit one of the tabs 36 to have a range of motion corresponding to a 30° rotation of the puck 12 relative to the lug bucket 16. It is preferable that the number of slots 70 in the lug bucket 16 correspond to the number of tabs 36 in the puck 12.

Figure 3C:
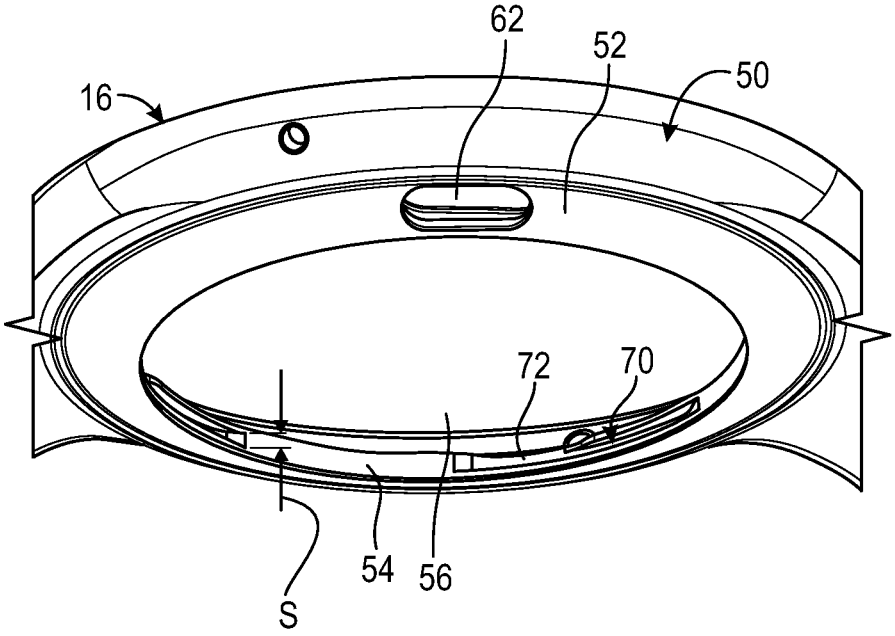
FIG. 3C is a bottom perspective view of the lug bucket of FIG. 1A.
Figure 3D:
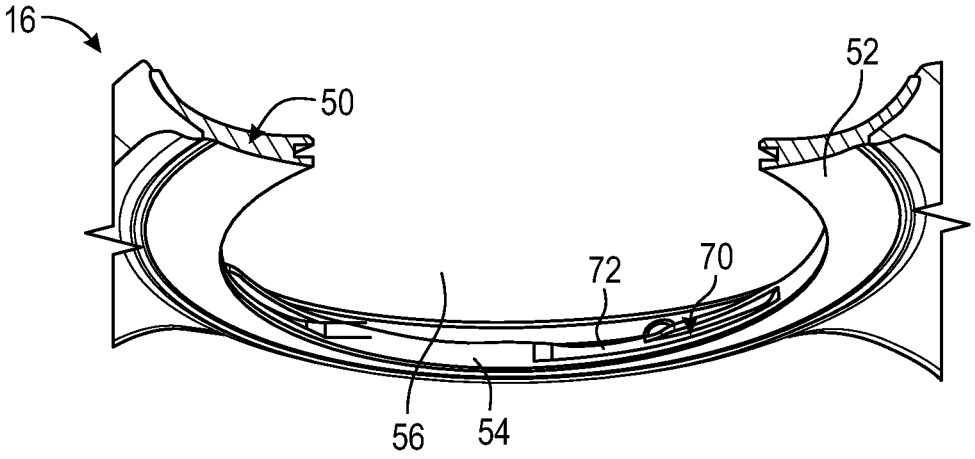
FIG. 3D is a perspective cross-sectional view of the lug bucket of FIG. 3D.

As shown in FIG. 3B, there are four evenly-spaced slots 70 that are equally distributed about the cylindrical wall 54 every 90°. However, in other examples, there may be any number of slots 70, and the slots may have any regular or irregular spacing about the cylindrical wall 54, so long as the slot spacing corresponds to complementary ones of the tabs 36 of the puck 12. As shown in FIG. 3C, each slot 70 may extend a portion of the distance between the top surface 51 and the bottom surface 52 and may have a height S that is slightly larger than the height T1 of a corresponding one of the tabs 36.

Each slot 70 may have an opening 72 extending substantially parallel to the cylindrical wall 54, such that a portion of the top surface 51 is recessed away from the cylindrical wall 54. This opening 72 may be an entry location for a corresponding one of the tabs 36 of the puck 12 when the coupling protrusion 30 is engaged into the central opening 56. Each opening 72 may extend circumferentially about the same distance as the circumferential length of the corresponding tabs 36, so that the tabs may be accommodated within the openings.

Referring to FIG. 3A, if the top surface 51 of the circular ledge 50 has a circumference of about 144 mm at the location of the cylindrical wall 54, and each tab 36 has a length T2 of about 8 mm, to permit the puck 12 to have a range of rotational motion M of about 30° (a circumferential distance of about 12 mm, i.e., 1/12 of the circumference) when coupled to the lug bucket 16, each slot 70 would need to have a total circumferential length L2 of about 20 mm, which is the sum of the tab length T2 and the range of rotational motion M.

Once the tabs 36 are rotated beyond the openings 72 of the slots 70, the engagement of the tabs 36 into the slots can translationally lock the puck 12 to the lug bucket 16 by interference between top and bottom outer surfaces of the tabs and confronting top and bottom inner surfaces of the slots, so that the puck cannot be translated out of the lug bucket without first rotating it. The combination of the engagement of one of the buttons 42 into the opening 62 and the engagement of the tabs 36 into the slots 70 may translationally and rotationally lock the puck 12 to the lug bucket 16 until a user depresses the button to withdraw it from the opening while rotating the puck to align the tabs with the slots, thereby permitting the puck to then be translated out of the lug bucket. This engagement will be described further below with reference to FIGS. 4A-4D.

Figure 4A:
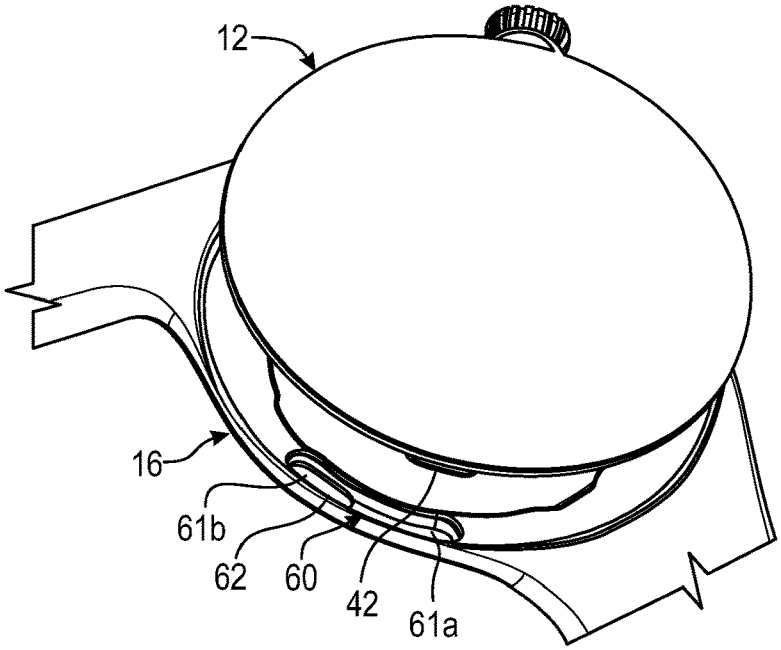
FIG. 4A is a top perspective view of the watch system of FIG. 1A, with the puck shown spaced apart from the lug bucket.
Figure 4B:
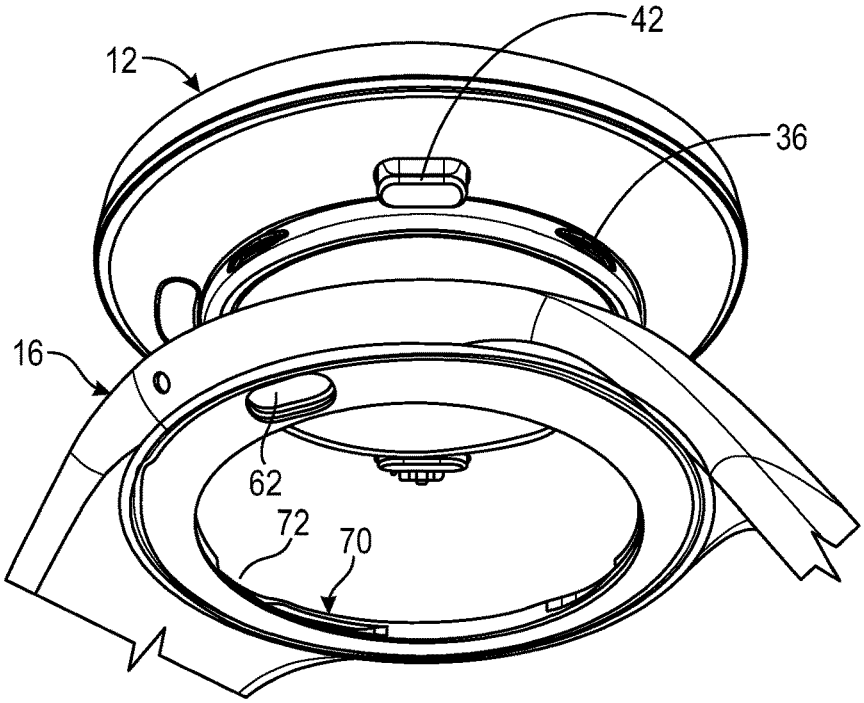
FIG. 4B is a bottom perspective view of the watch system of FIG. 1A, with the puck shown spaced apart from the lug bucket.

Referring to FIGS. 4A-4D, a method of engagement of the puck 12 into the lug bucket 16 will now be described. FIGS. 4A and 4B show the puck 12 and the lug bucket 16 in an initial rotational configuration, in which the puck is offset from its final rotational configuration relative to the lug bucket by about 30°. As will be described further below, the 30° rotational travel of the puck 12 within the lug bucket 16 is merely an example, so many other potential rotational travel angles may be used. In this initial rotational configuration, the buttons 42 of the puck 12 are disposed above and rotationally aligned with first end portions 61*a* of the tracks 60 of the lug bucket 16, and the tabs 36 of the puck are disposed above and rotationally aligned with the openings 72 of the slots 70 of the lug bucket.

The puck 12 may then be translated vertically into the lug bucket 16, so that the buttons 42 are disposed within the first end portions 61*a* of the tracks 60, and the tabs 36 are disposed within the openings 72 of the slots 70. Next, the puck 12 may be rotated (clockwise from a top viewpoint in the examples shown) relative to the lug bucket 16 by about 30°. During this rotation, the buttons 42 slide within the tracks 60 from the first end portions 61*a* to the second end portions 61*b*, one of which contains the opening 62. Also during this rotation, the tabs 36 slide within the slots 70 from the openings 72 to the opposite ends of the slots.

Figure 4C:
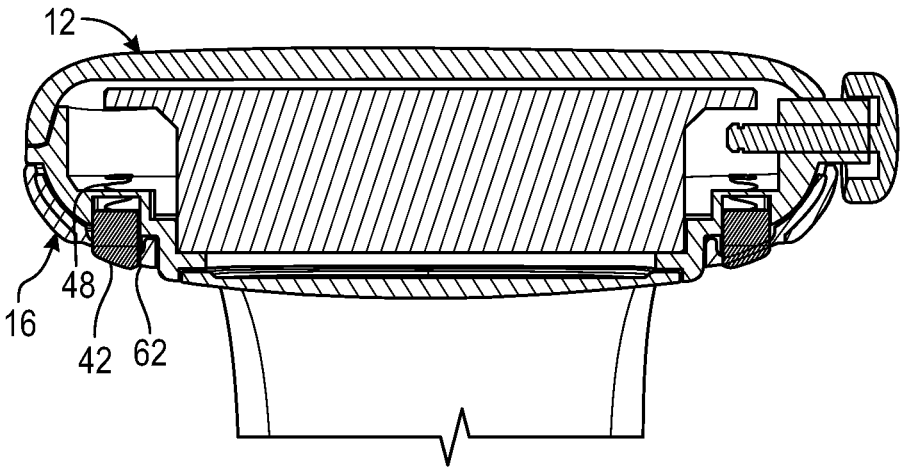
FIG. 4C is a side cross-sectional view of the of the watch system of FIG. 1A, with the puck shown coupled to the lug bucket.
Figure 4D:
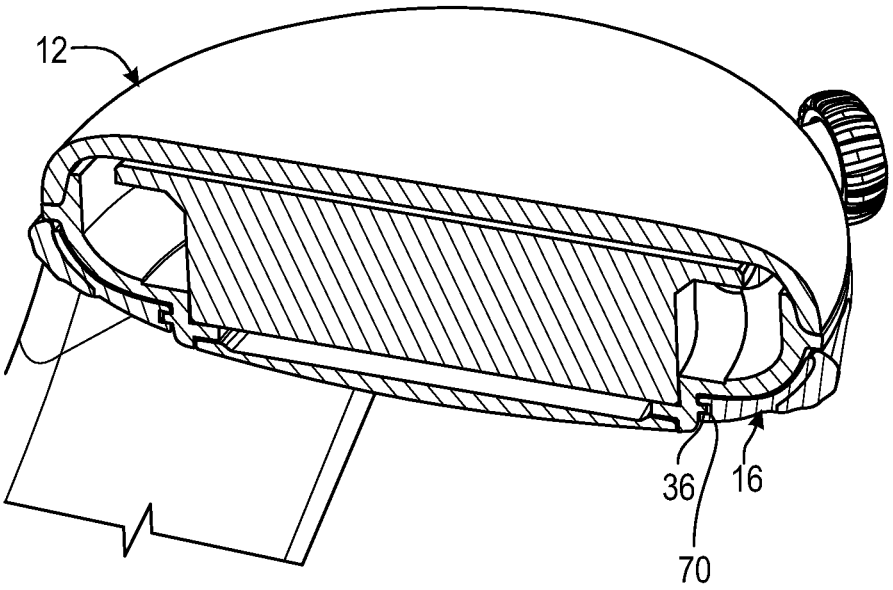
FIG. 4D is another side cross-sectional view of the of the watch system of FIG. 1A, with the puck shown coupled to the lug bucket.

As can be seen in FIGS. 4C and 4D, once the rotation is complete and one of the buttons 42 is rotationally aligned with the opening 62, the spring element 48 forces the button into the opening 62, thereby rotationally locking the puck 12 to the lug bucket 16. Also at this time, since the puck 12 cannot be rotated relative to the lug bucket 16, the vertical interference between the tabs 36 and the slots 70 translationally lock the puck to the lug bucket 16.

When a user desires to swap the lug bucket 16 for one with a different color or material or to swap the puck 12 for one with different functionality, the user may remove the puck from the lug bucket as will be described below. A user may also desire to swap the lug bucket 16 to change the style, material, or functionality of the wristband 18. For example, a user may wish to change the wristband 18 from a right-handed one to a left-handed one. A user may also desire to swap a smartwatch puck 12 for a puck that is has analog watch functionality, or for a puck that may serve as a decorative portion of a bracelet.

The user may remove the puck 12 from the lug bucket 16 by depressing the exposed button 42 into the opening 62 using a finger, for example Once the button 42 has been withdrawn from the opening 62, the puck 12 may be rotated by about 30° relative to the lug bucket 16 in the opposite direction that was used to couple the puck to the lug bucket (counterclockwise from a top viewpoint in the examples shown). This rotation will rotationally align the tabs 36 with the openings 72 of the slots 70, so that the user may translate the puck 12 out of the lug bucket 16, to return the puck and lug bucket to the spaced-apart positions shown in FIGS. 4A and 4B.

The interlocking features described above may be varied from the particular example shown in FIGS. 1A-4D. For example, instead of the tabs 36 that are provided on the puck 12 and the corresponding slots 70 that are provided on the lug bucket 16, tabs may be provided on the lug bucket (e.g., extending from the cylindrical wall 54) and corresponding slots may be provided on the puck (e.g., extending into the cylindrical wall 32).

Alternatively, instead of the buttons 42 that are provided on the puck and the corresponding tracks 60 that are provided on the lug bucket 16, buttons may be provided on the lug bucket (e.g., extending from the top surface 51 of the circular ledge 50) and corresponding tracks may be provided extending into the peripheral ring 40 of the enclosure 20. In such a variation, one or both of the buttons may be coupled to another button or actuatable feature in a location that is accessible to the user.

In another example, instead of having a button 42 that extends into an opening 62 within a corresponding track 60, the opening 62 may be omitted and replaced with a different feature such as a detent. In such a variation, a raised bump or a detent may be provided within the corresponding track 60 that is of a sufficient height to interfere with the button 42 to keep it temporarily locked at the second end portions 61*b* of the track. When a user desires to decouple the puck 12 from the lug bucket 16, the user may apply sufficient force to overcome the small interference between the raised bump and a lateral outward side of the button 42.

The particular 30° rotation angle M that is described above in the particular example shown in FIGS. 1A-4D may also be varied. For example, the rotation angle may be set to any desired angle, such as 15, 20, 40, 45, 60, 75, 90, or 120 degrees, among others. Depending on the particular rotation angle chosen, the length of the tracks 60 may be changed, and the number of tabs 36 and slots 70 as well as the length of the slots may also be changed.

Although in the example shown in FIGS. 1A-1D, the puck 12 has a coupling protrusion 30 that is configured to extend through a central opening 56 of the lug bucket 16, in other example, the central opening may be omitted, such that the circular ledge extends in a continuous manner across a central plate member without an opening therein. In such a variation, the puck may have a flat bottom surface without a coupling protrusion, and the flat bottom surface may be positioned to confront a central plate member of the lug bucket.

Unless otherwise stated, the foregoing alternative examples are not mutually exclusive, but may be implemented in various combinations to achieve unique advantages. As these and other variations and combinations of the features discussed above can be utilized without departing from the subject matter defined by the claims, the foregoing description of the embodiments should be taken by way of illustration rather than by way of limitation of the subject matter defined by the claims. In addition, the provision of the examples described herein, as well as clauses phrased as "such as," "including" and the like, should not be interpreted as limiting the subject matter of the claims to the specific examples; rather, the examples are intended to illustrate only one of many possible embodiments. Further, the same reference numbers in different drawings can identify the same or similar elements.

The invention claimed is:

1. A watch system, comprising:

a watchband including a flexible member configured to be mounted onto a wrist of a user;

a lug bucket coupled to the watchband and including a circular ledge, the circular ledge having a central opening extending therethrough; and a puck including watch functionality, the puck being configured to be removably coupled to the lug bucket, the puck having an enclosure defining a peripheral ring adapted to be seated on the circular ledge when the puck and the lug bucket are engaged;

wherein the lug bucket and the puck have corresponding locking features that are configured to rotationally and translationally fix the puck to the lug bucket, the corresponding locking features configured to be engaged when the puck is translated relative to the lug bucket and rotated relative to the lug bucket by a predetermined rotation angle, and wherein when the puck and the lug bucket are engaged, a top surface of the puck extends above a top surface of the lug bucket and a bottom surface of the puck is accessible through the central opening of the circular ledge.

2. The watch system of claim 1, wherein the corresponding locking features include a button that is configured to be inserted into a corresponding track and a tab that is configured to be inserted into a corresponding slot.

3. The watch system of claim 2, wherein the button and the tab each extend from the puck, and the track and slot each extend into the circular ledge of the lug bucket.

4. The watch system of claim 3, wherein the watch system has an engaged configuration in which the button is rotationally locked relative to the lug bucket by interference between a side of the button and a feature of the circular ledge, and in which the tab is translationally locked relative to the lug bucket by interference between a surface of the tab and a corresponding confronting surface of the slot.

5. The watch system of claim 4, wherein in the engaged configuration, an outer lateral side of the button interferes with an inner lateral surface of an opening extending within the corresponding track.

6. The watch system of claim 1, wherein the predetermined rotation angle is between about 15° and about 120°.

7. The watch system of claim 1, wherein the puck has smartwatch features including a display, sensors, and a battery.

8. A coupling system, comprising:

a lug bucket including a circular ledge, the circular ledge having a central opening extending therethrough; and a puck configured to be removably coupled to the lug bucket, the puck having an enclosure defining a peripheral ring adapted to be seated on the circular ledge when the puck and the lug bucket are engaged;

wherein the lug bucket and the puck have corresponding locking features that are configured to rotationally and translationally fix the puck to the lug bucket, the corresponding locking features configured to be engaged when the puck is translated relative to the lug bucket and rotated relative to the lug bucket by a predetermined rotation angle, and wherein when the puck and the lug bucket are engaged, a top surface of the puck extends above a top surface of the lug bucket and a bottom surface of the puck is accessible through the central opening of the circular ledge.

9. The coupling system of claim 8, wherein the corresponding locking features include a button that is configured to be inserted into a corresponding track and a tab that is configured to be inserted into a corresponding slot.

10. The coupling system of claim 9, wherein the button and the tab each extend from the puck, and the track and slot each extend into the circular ledge of the lug bucket.

11. The coupling system of claim 10, wherein the coupling system has an engaged configuration in which the button is rotationally locked relative to the lug bucket by interference between a side of the button and a feature of the circular ledge, and in which the tab is translationally locked relative to the lug bucket by interference between a surface of the tab and a corresponding confronting surface of the slot.

12. The coupling system of claim 11, wherein in the engaged configuration, an outer lateral side of the button interferes with an inner lateral surface of an opening extending within the corresponding track.

13. The coupling system of claim 8, wherein the predetermined rotation angle is between about 15° and about 120°.

14. The coupling system of claim 8, wherein the puck has smartwatch features including a display, sensors, and a battery.

15. A method of removably coupling a puck to a watchband assembly, the puck having watch functionality, the method comprising:

providing the watchband assembly including a lug bucket coupled to a watchband comprising a flexible member configured to be mounted onto a wrist of a user, the lug bucket including a circular ledge, the circular ledge having a central opening extending therethrough, the puck having an enclosure defining a peripheral ring adapted to be seated on the circular ledge when the puck and the lug bucket are engaged;

translating the puck relative to the lug bucket;

rotating the puck relative to the lug bucket by a predetermined rotation angle; and engaging corresponding locking features of the puck and the lug bucket during the translating and the rotating of the puck, the corresponding locking features rotationally and translationally fixing the puck to the lug bucket, wherein when the puck and the lug bucket are engaged, a top surface of the puck extends above a top surface of the lug bucket and a bottom surface of the puck is accessible through the central opening of the circular ledge.

16. The method of claim 15, wherein the translating of the puck includes inserting a button into a corresponding track and inserting a tab into a corresponding slot.

17. The method of claim 16, wherein the button and the tab each extend from the puck, and the track and slot each extend into the circular ledge of the lug bucket.

18. The method of claim 17, wherein the rotating of the puck includes moving the button within the corresponding track and moving the tab within the corresponding slot until the button is rotationally locked relative to the lug bucket by interference between a side of the button and a feature of the circular ledge, and until the tab is translationally locked relative to the lug bucket by interference between a surface of the tab and a corresponding confronting surface of the slot.

19. The method of claim 15, further comprising disengaging the puck from the lug bucket by rotating the puck relative to the lug bucket by the predetermined rotation angle and translating the puck relative to the lug bucket.

20. The method of claim 19, wherein the disengaging of the puck from the lug bucket includes depressing a button until the puck is no longer rotationally fixed to the lug bucket.

* * * * *